US006464322B2

(12) United States Patent
Dunand

(10) Patent No.: US 6,464,322 B2
(45) **Date of Patent: *Oct. 15, 2002**

(54) INK JET PRINTER AND A PROCESS FOR COMPENSATING FOR MECHANICAL DEFECTS IN THE INK JET PRINTER

(75) Inventor: Alain Dunand, Grenoble (FR)

(73) Assignee: Imaje S.A., Bourg les Valence Cedex (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/727,996

(22) Filed: Dec. 1, 2000

(65) Prior Publication Data

US 2001/0040599 A1 Nov. 15, 2001

(30) Foreign Application Priority Data

Dec. 3, 1999 (FR) ..... 99 15271
Dec. 3, 1999 (FR) ..... 99 15270
Mar. 7, 2000 (FR) ..... 00 02900

(51) Int. Cl.[7] ..... B41J 2/12
(52) U.S. Cl. ..... 347/19; 347/78
(58) Field of Search ..... 347/78, 79, 80, 347/81, 6, 14, 16, 19

(56) References Cited

U.S. PATENT DOCUMENTS 3,786,517 A 1/1974 Krause ..... 347/74
3,898,671 A * 8/1975 Berry et al. ..... 347/76
4,160,982 A 7/1979 Keur ..... 347/32
4,321,607 A 3/1982 Heibein et al. ..... 347/79
4,551,731 A * 11/1985 Lewis et al. ..... 347/78
4,604,631 A 8/1986 Jinnai et al. ..... 347/9
4,800,396 A 1/1989 Hertz ..... 347/79
5,049,898 A * 9/1991 Arthur et al. ..... 347/19
5,160,939 A 11/1992 Bajeux et al. ..... 347/78
5,397,192 A * 3/1995 Khormaee ..... 400/708
5,477,244 A * 12/1995 Shibata et al. ..... 347/19
5,481,288 A 1/1996 Keeling et al. ..... 347/80
5,517,216 A * 5/1996 Stamer et al. ..... 347/6
5,828,387 A * 10/1998 Wataya et al. ..... 347/14
6,003,980 A * 12/1999 Sheinman et al. ..... 347/78
6,280,023 B1 * 8/2001 Ufkes ..... 347/78

FOREIGN PATENT DOCUMENTS

EP 0 036 789 9/1981
EP 0 863 012 9/1998
FR 2.198.410 3/1974
FR 2 636 884 2/1990

OTHER PUBLICATIONS

T.G. Twardeck, Effect of Parameter Variations on Drop Placement in an Electrostatic Ink Jet Printer. Jan. 1977, IBM J. Res. Develop., pp. 31–36.
C.A. Bruce, Dependence of Ink Jet Dynamics on Fluid Characteristics. May 1976, IBM J. Res. Develop. pp. 258–270.
Patent Abstracts of Japan, Deflection Controlled Ink Jet Recording Apparatus. Publication No. 59068254, Apr. 1984.
WO 98/43817, Ink–Jet Printing Apparatus and Method. Oct. 8, 1998.

* cited by examiner

*Primary Examiner*—Anh T. N. Vo
*Assistant Examiner*—Blaise L Mouttet
(74) *Attorney, Agent, or Firm*—Pearne & Gordon LLP

(57) ABSTRACT

Process for compensation of mechanical defects in an ink jet printer in which the ink viscosity, the jet velocity, the distance at which the ink jet is broken into droplets and the phase are independently servocontrolled to respect set values, process according to which the droplet arrival position is compared with a reference position, and mechanical defects are compensated by varying the electrical charge on the droplets. The invention also relates to a printer equipped with checking and servocontrol means so that compensation according to the process can be applied. The mechanical assembly of the printer will thus be simplified.

9 Claims, 7 Drawing Sheets

INK JET PRINTER AND A PROCESS FOR COMPENSATING FOR MECHANICAL DEFECTS IN THE INK JET PRINTER

DOMAIN OF THE INVENTION

The present invention relates to ink jet printers in which ink jets are formed and electrically charged and then deviated to strike a print substrate. It relates to a process designed to simplify the mechanical assembly of print heads and a printer applying this process.

TECHNOLOGICAL BACKGROUND

It is known that a pressurized ink jet ejected through a print nozzle can be broken into a series of individual droplets, each droplet being individually charged in a controlled manner. Constant potential electrodes along the path of these individually charged droplets deviate the droplets by a variable amount depending on their charge. If it is not required that a droplet should reach the print substrate, its charge is controlled such that it is deviated to an ink recovery reservoir. The operating principle of this type of ink jet printer is well known, and for example is described in U.S. Pat. No. A-4,160,982. As described in this patent and as shown in FIG. 1, this type of printer comprises a reservoir 11 containing electrically conducting ink 10 that is distributed through a distribution duct 13 to a droplets generator 16. The role of the droplets generator 16 is to form a set of individual droplets starting from the pressurized ink in the distribution duct 13. These individual droplets are electrically charged by means of a charge electrode 20 powered by a voltage generator 21. The charged droplets pass through a space between two deviation electrodes 23, 24 and are deviated by a variable amount depending on their charge. The least deviated or undeviated droplets are directed to an ink recovery reservoir 22, whereas deviated droplets are directed to a substrate 27. The successive droplets in a burst reaching the substrate 27 can thus be deviated to an extreme low position, an extreme high position and any number of intermediate positions, the set of droplets in the burst forming a line with height $\Delta X$ approximately perpendicular to a relative direction of advance between the print head 25 and the substrate. The print head consists of the droplet generator 16, the charge electrode 20, the deviation electrodes 23, 24 and the recovery reservoir 22. In general, this head 25 is enclosed in a casing not shown. The deviation movement applied to the charged droplets by the deviation electrodes 23, 24 is complemented by a movement along a Y axis perpendicular to the X axis, between the print head and the substrate. The time elapsed between the first and last droplets in a burst is very short. The result is that despite continuous movement between the print head 25 and the substrate, it can be assumed that the substrate has not moved with respect to the print head during the time of a burst. Bursts are fired at regular intervals in space. If all droplets in each burst were directed towards the substrate, then a sequence of lines with height $\Delta X$ would be printed. In general, only some droplets in the burst are directed towards the substrate. Under these conditions, the combination of the relative movement of the head and the substrate, and the selection of the droplets in each burst that are directed towards the substrate, is a means of printing any pattern such as that shown in 28 in FIG. 1. If the line that is drawn with the droplets in a burst is in a direction X, the relative movement of the head and the substrate in the plane of the substrate is in a direction Y perpendicular to X. The undeviated droplets are directed to the recovery reservoir along a path Z perpendicular to the x, y plane of the substrate. Printed droplets reach the substrate by following paths slightly deviated from direction Z.

If the relative movement of the head and the substrate takes place continuously along the largest dimensions of the substrate, there will usually be several print heads printing bands parallel to each other. One example of this type of use is shown in FIGS. 1 and 2 in the patent issued to IBM, as number FR 2 198 410.

If the relative movement of the print head and the substrate in the Y direction takes place along the smallest dimension of the substrate, printing is done band by band, with the substrate performing an intermittent advance movement in the X direction after each scanning. The relative movement of the print head and the substrate is called the "scanning movement". The scanning movement is thus composed of a forward and return movement between a first edge of the substrate and a second edge of the substrate. The movement between one edge and the other edge of the substrate is a means of printing a band of height L, or frequently a part of the band of height $\Delta X_b$ where $\Delta X_b$ is usually a sub-multiple of L, without stopping. All bands printed in sequence thus form the pattern to be printed on the substrate. Each time that a band or a part of band is printed, the substrate is advanced by the distance between two bands or parts of bands to print the next band or part of band. Printing may be done during the forward movement only, or during the forward and return movements of the print head with respect to the substrate.

When the pattern to be printed is colored, the different shades of colors are the result of ink impacts from nozzles supplied by inks of different colors being superimposed and placed adjacent to each other. The system for relative displacement of the substrate with respect to the print heads is achieved such that a given point on the substrate is presented in sequence under each of the different colored ink jets.

Usually, the print system comprises several jets of the same ink operating simultaneously, either by multiple heads being adjacent to each other or by the use of multi-jet heads, or finally by the combination of these two types of heads in order to achieve high print speeds. In this case, each ink jet prints a limited part of the substrate. Known means of controlling the different jets will now be described with reference to FIG. 2.

The pattern to be printed is described by a numeric file. This file may be formed using a scanner, a calculator aided graphic creation pallet (CAD) transmitted using a calculator data exchange network, or it may simply be read from a peripheral reading a numeric data storage medium (optical disk, CD-ROM). The numeric file representing the colored pattern to be printed is firstly split into several binary patterns (or bitmaps) for each ink. Note that the case of the binary pattern is a non-limitative example; in some printers, the pattern to be printed is of the "contone" type, in other words each position may be printed by a variable number of droplets from 1 to M for each ink. Part of the binary pattern is extracted from the file for each jet corresponding to the width of the band that will be printed. FIG. 2, which shows the control electronics of a jet, shows a memory 1 in which the numeric pattern cut into bands is stored, this storage memory containing information about a color. For printing each band, an intermediate memory 2 contains the data necessary for printing the band with the said color. Descriptive data for the band to be printed are then input into a calculator 3 that calculates the charge voltages of the different drops that will form the band for this color. These data are input into the calculator in the form of a sequence of frame descriptions that, when combined, will form the band. The calculator 3 that calculates droplet charge voltages is often in the form of a dedicated integrated circuit. This calculator 3 calculates the sequence of voltages to be applied to the charge electrodes 20, in real time, in order to print a given frame defined by its frame description, as loaded from the intermediate memory 2. An output side electronic circuit 4, called the "droplet charge sequencer", synchronizes the charge voltages firstly with the times at which droplets are formed, and secondly with the relative advance of the print head and the substrate. The advance of the substrate with respect to the print head is materialized by a frame clock 5, the signal of which is derived from the signal from an incremental encoder of the position of the print unit relative to the substrate. The droplet charge sequencer 4 also receives a signal from a droplet clock 6. This droplet clock is synchronous with the droplet generator control signal 16. It is used to define transition instants of the various charge voltages applied to droplets to differentiate their paths. Numeric data originating from the droplets charge sequencer 4 are converted into an analog value by a digital analog converter 8. This converter outputs a low voltage level and usually requires the presence of a high voltage amplifier 21 that will power the charge electrodes 20. The illustrations of prior art given with reference to FIGS. 1 and 2 are intended to make the domain and benefits of the invention clear, but obviously prior art is not limited to the descriptions made with reference to these Figures. Other arrangements of electrodes and recovery reservoirs for unused ink droplets are described in a very extensive literature. An electromechanical arrangement of charge electrode print nozzles and deviation electrodes as described in invention patent number FR 2 198 410 issued to International Business Machine Corporation (IBM) with reference to FIGS. 1 to 3 in this patent could very well be used in this invention. Similarly, the electronic control circuit for the charge electrodes could be illustrated by the circuit described with relation to FIG. 4 in the same patent. Also, data to be printed need not necessarily be in the form of binary files, but they could be in the form of files containing words of several bits, to translate the fact that each position of the substrate may receive several ink droplets of the same color.

It can be understood that for printing, and particularly for color printing, the necessary superposition of droplets originating from different nozzles outputting the different ink colors must be very precise. The main print defects that are generated by all known print systems are related to misalignments along the direction of the relative movement between the print head and the substrate. This defect appears as light or dark lines produced when printing in successive scans. These defects may appear in the space between two bands that in principle must be equal to the interval between two adjacent droplets in a single frame, or within a single band, in the space delimiting the areas printed by different jets, or even inside the frame printed by a jet at the space between two adjacent droplets in the frame. These misalignment defects may be caused either by defects specific to some jets in the print head (mechanical or electrical defects) or substrate positioning errors, or errors of the relative positioning between different print heads, or even between jets in the same print head. Various solutions have been proposed to limit or to eliminate misalignment problems, but all these solutions limit the print rate to a value below the nominal print rate, sometimes by a very high factor, or by redundant print heads and therefore at high cost. Some examples of frequently used known solutions for limiting misalignment will be described very briefly below; a first type of solution is based on fine mechanical adjustments of the positions of print heads by means of micrometric tables. This solution is expensive due to the necessary number of micrometric tables, and frequently painstaking due to the number of trial and error attempts that are necessary.

Another frequently used type of solution consists of using a very high overlap ratio between adjacent drops, in order to avoid white misalignments. These white misalignments correspond to the lack of coverage of the substrate. Dark misalignments are less easily seen and it is preferred to have a misalignment defect composed of dark lines rather than a misalignment defect composed of white lines. The solution consisting of increasing the overlap ratio between adjacent droplets is efficient to compensate for defects within a single band and to a certain extent misalignment defects between bands, but it has the disadvantage that it requires a very large quantity of ink per unit area of substrate and causes difficulties in drying or deformation of the substrate.

A third type of solution for eliminating misalignment defects on printers operating in scanning consists of printing the substrate partially during each scanning. The substrate is completely covered by increasing the number of times that the substrate is scanned. Printing in several passes in this way uses several strategies for interlacing the positions of droplets from different jets. One example of interlacing even and odd lines is given in patent number U.S. Pat. No. A-4,604,631 issued to the RICOH Company. One advantage of this solution, frequently related to a high overlap ratio, is that it enables a substrate drying time, but it reduces the print rate by a factor of between 2 and 16.

Concerning misalignment and other printing defects, the use of patterns has been envisaged in which a real printed pattern is compared with a reference pattern to deduce choices of nozzles or modifications to be made to some printer adjustment parameters. Patent application EP 0 589 718 A1 made by HEWLETT PACKARD allows for the use of patterns composed of a sequence of lines offset from each other. The printer user examines the different printed models and chooses an alignment that he likes, using a control panel. The choices are then stored for subsequent use.

A model pattern that can be used to correct printer defects is described in patent application No. EP 0 863 012 A1 made by HEWLETT PACKARD. For example, this model pattern can easily be read using a camera so that automatic corrections can be made by comparing the printed pattern to a reference pattern. Finally, patent application No WO 98/43817 made by JEMTEX INK JET PRINTING LTD., describes the use of a pattern to make various parameter corrections. According to the description in this application, the pattern is used to recognize different error types, in other words ink droplet velocity errors, phase errors due to incorrect sequencing of the application of the charge voltage, offset errors in the X direction, offset errors in the Y direction, and angular offset errors. Velocity errors and offset errors in the X direction are corrected by modifying the droplet charge voltage. Phase errors due to incorrect sequencing in the application of the charge voltage are corrected by modifying the sequence of the droplet charge pulse. Offset errors in the Y direction, in other words in the scanning direction, are compensated by restructuring the data sequence. The same procedure is used for angular errors. For reasons that will be described later, use of this type of a pattern can give good droplet positioning on the substrate, but it creates other defects (essentially colorimetry defects), and difficulties in making permanent settings to the printer.

BRIEF DESCRIPTION OF THE INVENTION

The main purpose of this invention is to reduce difficulties in installing print heads on a printer, while maintaining good print quality. A good print quality assumes good color reproducibility, a constant size due to the impact of droplets and their spreading on the substrate, and a clearly defined relative position of the droplets on the substrate. It is also intended to increase the reliability and availability of the printer. It is also intended to limit printed substrate losses when defects occur. It is intended to simplify maintenance operations. Finally, it is also intended to give a stable print quality, in other words to avoid changes to this quality.

The print quality of a color ink jet printer depends on a large number of parameters, some of which are dependent on each other; as mentioned above, three main phenomena that control print quality can be defined:

the colorimetric characteristic of inks, the size of dots resulting from their impact and their spreading on the substrate, and finally, the relative position of droplets on the substrate.

The colorimetric characteristic of ink depends mainly on its composition, the main elements being the concentration of the coloring agent, the concentration of solvent and the concentration of resin. Patent No. FR 2 636 884 issued to the applicant describes a system for measuring and maintaining the viscosity of ink in order to maintain jet velocity conditions, while the pressure remains fixed. Viscosity corrections are made by adding solvent or an ink with a concentration higher than the nominal concentration. A temperature variation can cause a change to the viscosity even if the ink composition is unchanged. This is why a preferred embodiment of the invention described in this patent issued to the applicant describes a means for adjusting and servocontrolling the viscosity $\eta$ of the ink, taking account of the ink temperature. The viscosity and temperature T are determined at the same point in the ink, and solvent or more concentrated ink additions are made depending on the difference in the viscosity $\Delta\eta$ from a set value of a viscosity that depends on the measured temperature. With the process described in this patent, the concentration of coloring agent in the ink is maintained precisely. If the ink temperature at the print head is also controlled, for example by controlling the ambient temperature, the viscosity of the ink in the nozzle is automatically controlled. Control over the viscosity and the concentration of the coloring agent are necessary conditions for maintaining good colorimetry, and for maintaining a constant relation between the variation in the velocity of a droplet at the outlet from a print nozzle as a function of the constant pressure applied to it.

The impact size of droplets on the substrate depends on the geometry of the nozzles that are made under tight and controlled tolerances during manufacturing, on their ejection velocity and therefore impact velocity, and local drop spreading conditions on the substrate, namely the ink evaporation rate and its surface tension on the said substrate, which both depend on the temperature. Spreading for a given substrate and a given ambient temperature depends on the physicochemical characteristics of the ink and the droplet impact velocity.

The relative position of droplets on the substrate depends on the path of the droplets from each jet in the print head, the layout of jets in the print head, and the relative position between the print head and the substrate. It has been seen that the droplets are electrically charged, and then deviated by deviation electrodes, by a variable amount depending on their charge. The result is that the path of the droplets depends on their velocity and their charge. Good charging of the droplets is only possible if the droplet is separated from the jet at a precisely defined location, and the electrical pulse defining the charge of the droplets is applied at a precisely known time. It has been seen above that the velocity for a given viscosity depends on a pressure applied to the fluid. It is also known that the distance between the nozzle and the location at which the droplets in a jet are formed depends on the amplitude of oscillations applied, for example to a piezoelectric crystal maintaining vibrations in the ink. Therefore, a good droplet charge requires good control of the phase between the formation of droplets and the instant at which the droplets are charged, the phase itself being variable with the droplet velocity. Means of individually controlling parameters such as the ink viscosity as a function of its temperature, the droplet velocity by acting on the pressure in the ink reservoir, the droplet charge phase and the jet length before it is broken into droplets by controlling the voltage of a piezoelectric crystal, are all known individually in prior art. However, printers according to prior art do not usually control all of these parameters, possibly due to poor knowledge of how the different parameters depend on each other to affect the print quality. Thus for example, ink characteristics such as viscosity can be controlled without simultaneously servocontrolling the jet velocity, since it is considered that keeping the ink viscosity and pressure constant is sufficient to ensure constant velocity of the droplets. This approach fails, particularly when the orifice of a nozzle or filters in the ink feed circuit are blocked up. If the physicochemical characteristics of the ink are servocontrolled, it is also important to keep the ink droplet velocity and the velocity of the impact on the substrate within a predetermined tolerance. Frequently, also in systems according to prior art, the positioning precision of the droplets is considered as being the only factor that influences the print quality. Thus, in patent application WO 98/43817 mentioned above, the position at the droplets is measured on a pattern and defects are corrected in several ways. In particular, path defects resulting from the droplet velocity being outside its tolerances are corrected by varying the electrical charge. It has been seen that the droplet velocity influences the path and the size of the droplet on impact. Therefore there is no guarantee of the print quality. A correction to the droplet charge may possibly be made to bring these droplets back within their nominal path, but their impact diameter will not have been corrected and the coloring agent will be spread over a too large or too small area, thus changing the colorimetry.

This invention is intended to give a good print quality and to simplify the assembly of the printer. In a printer according to the invention, the phase of the droplets, the jet length before it is broken into droplets, the velocity of the ink jet, the temperature, viscosity and composition of the ink are continuously controlled by independent loops. If all these parameters are controlled, the only reason for an error in the position of droplets will be a mechanical defect or tolerance limits on electronic devices. Under these conditions, printing a pattern and comparing it with a reference pattern, followed by appropriate modification to the droplet charge, can modify this path to restore its nominal value. Since the other parameters are controlled, this change to the charge of the droplets will not compensate the jet velocity or the ink composition, or the size of the ink droplets on impact being outside tolerances, and consequently the print quality will be maintained.

The process according to the invention is intended to eliminate misalignment problems without affecting the print speed.

This invention does not require a high droplet overlap ratio. It can achieve high print rates with a relatively small number of print heads. It can also reduce the number of mechanical adjustment devices. According to the invention, an operation is performed before the printer is first used in which electrical settings are made for it. This initial setting is done when the parameter servocontrol loops are active, and for example will be used to adjust the position of the frame by correcting what we will call a static translation error, and it will also be used to adjust the height of the frame by modifying what we will call an expansion error. This will be done by using the printer to print a known pattern. This pattern will be compared with a reference pattern in order to determine the differences between the real position of points on the printed pattern and the nominal position of the corresponding points on the reference pattern. Differences between corresponding points are memorized. Successive print phases are then performed to print patterns defined by a set D of numeric data, in which the memorized differences are used to calculate corrections to be applied to:

nominal voltages to be applied to droplet charge electrodes, as a function of the row j of the nominal position of the dot printed by the droplet, or the number of positions depending on the edge detection signal, and the corrections determined in this way will be applied to the corresponding nominal values.

In one embodiment, the values of the static translation error and the expansion error are corrected. The value of the static translation error will be corrected by adding an algebraic electrical charge to each of the droplets leaving the printer nozzles, to compensate for this translation error. The expansion error arises if the difference between the charges distributed to the droplets with the greatest deviation and the droplets with the least deviation in a burst forming a frame is too large or too small. The frame is too large when the difference between the high and low points on the frame is too large. This means that the droplet corresponding to the highest point is not sufficiently deviated while the droplet corresponding to the lowest point is deviated too much. Therefore, to correct this, the charge of the droplet corresponding to the highest point needs to be increased and the charge of the droplet corresponding to the lowest point needs to be decreased. An equalization applied to intermediate droplets in the burst corrects the charge applied to intermediate droplets as a function of corrections made to the charges on the extreme droplets in the frame. However if the frame is too narrow, then the difference between the highest point and the lowest point in a burst is too narrow and the charge in the droplet corresponding to the highest point will be reduced so that this droplet is less deviated and the charge of the droplet corresponding to the lowest point is increased such that this droplet is deviated more. An equalization of the correction values of charges applied to intermediate droplets between the last and the first drop refines the frame adjustment, in the same way as for the very wide frame.

The real difference of each droplet from its nominal position can also be taken into account to calculate the position correction applied to each droplet.

In summary, the invention relates to a process for compensation of mechanical defects in an ink jet printer by adjusting the arrival position on a substrate of electrically charged ink droplets in an adjustable manner using charge electrodes, the droplets originating from a print head and the trajectories of the droplets being modifiable by deviation electrodes between N positions, between a first position $X_1$ and a last position $X_N$ and with N−2 intermediate positions, the N positions defining a frame in the form of a straight line segment approximately parallel to an X direction of the substrate, the process being characterized in that the following parameters are servocontrolled at all times during operation of the printer:

ink viscosity as a function of its temperature, so that its value remains within a predetermined tolerance by adding solvent or ink with a higher concentration of coloring agents, a jet velocity by acting on the ink feed pressure, a distance at which the jet is broken into droplets by acting on an adjustable parameter to maintain a predetermined breaking distance, a phase difference between instants at which electrical droplet charge pulses are applied and the periodic signal applied to the droplet generator that determines the formation of droplets by action on a timer circuit, and in that the following steps take place during a phase prior to the print phases:

a) a pattern is printed, b) the said printed pattern is compared with a reference pattern to deduce an algebraic difference $\Delta X_i$ between a real observed position and a corresponding nominal position, for the said print head and for an integer number a of positions, where a is greater than or equal to 2 and less than or equal to N, for each of the chosen a positions, where i varies from 1 to a, c) a static translation error θ is determined as being the difference between the center of gravity of the a actual observed positions and the center of gravity of the corresponding a nominal positions, d) for each of the a observed droplet positions, a position error $\delta_I$ is observed between the real position of each droplet corrected by the translation error, and the nominal position of each droplet, e) the value θ of the static translation error and the values $\delta_I$ of the droplet position errors from their initial nominal positions, are memorized, then, in each phase in which a pattern is printed defined by a set D of numeric data, a correction value to the nominal voltage is determined for each droplet to give a corrected value to be applied to the means of charging droplets directed towards the substrate, this calculation taking account of memorized values of translation and position errors, the data extracted from the set D of numeric data defining the pattern to be printed, and row j, where j is between 1 and N, of the nominal target print position.

Preferably, and as described above, the integer number a of real observed positions is equal to 2, these positions being the first and last positions. Also, if it is required to obtain a finer correction, it would be possible to measure the error in each of the N real positions of the droplets from their nominal position. Naturally, if the printer contains several nozzles distributed on one or several heads, the same operation will be applied for each of the nozzles. This does not mean that a different pattern has to be printed for each nozzle, a single pattern may be sufficient to control all the jets on each of the nozzles. In particular, if the different nozzles are provided for different color jets, it would be quite easy to create a single pattern that can be used to adjust all jets in all nozzles.

According to the invention, the overlap between consecutive droplets is minimized and it can result in a misalignment defect, particularly a white misalignment defect that appears regularly. This defect is very perceptible to the naked eye if it is regular. This defect, if it occurs, can be made less perceptible by applying a noise voltage superposed on the voltage applied to the droplet charge electrodes. The average amplitude of this noise voltage will depend on the row j of the droplet in the burst. Preferably, the maximum amplitude of the additional noise voltage will be equal to a fraction less than one of the difference between the nominal voltage to be applied to the row j droplet and the nominal voltage to be applied to the row j+1 droplet or the row j−1 droplet, in other words to one of the two droplets adjacent to the row j droplet. Preferably, the minimum amplitude of the additional noise voltage will be equal to the value of the voltage difference that can be obtained by varying the value of the least order bit of an analog digital converter that outputs onto a high voltage amplifier coupled to the droplet charge electrodes.

In this way, a slight noise will be applied to the position of the droplets and the regular defect consisting of a dark or light misalignment will no longer be visible, or it will be less visible.

The aspects of the invention that have been described above are a means of correcting misalignment errors, in other words positioning errors of the different frames in successive bands or adjacent jets and width errors of the different frames.

According to an other aspect of the invention that will now be mentioned, frame position errors in a Y direction perpendicular to the frame printing direction can also be corrected.

Most existing printers are equipped with a detector capable of detecting the left edge or right edge of the substrate. Printing begins as a function of a difference between the instantaneous numeric value of a counter representing the position of the head relative to the substrate and the value of this same counter at the time that an edge of the substrate is detected, and also as a function of data D related to the printout of the substrate contained in the print data memory. The difference between the number of positions is such that when this position number was counted after detection of a substrate edge, the print head is located at the location programmed by the data D to print the beginning of the band. It is possible that an offset may be observed in the Y direction between the nominal and real positions of a band. According to one aspect of the invention, this defect (called the dynamic offset error) can be corrected as follows. A comparison of the position of the first frame with respect to the nominal position of this first frame will be used to define an algebraic error of the first frame from its nominal position. A dynamic offset correction $\alpha$ will be defined as being a number of positions representing this error. A corresponding correction will be memorized and will then be used during printouts of successive frames in order to offset the printout of each frame in the band by this number of positions, the origin of the positions being counted being the edge of the substrate detected during each scan. Printing of the frames is offset if the head moves from left to right with respect to the substrate, to modify the number of positions between when the left edge is detected and the beginning of the band. Printing is offset if the head moves from right to left with respect to the substrate to modify the value of a counter representing the value of the position at which each frame in the band is printed. In particular, the position of the last frame is offset by the same number of positions as the first frame, and this should be taken into account when the print head returns. The correction thus takes account of the fact that the band is printed by a forward movement of the head from left to right and/or a return movement of the head from right to left.

It may be noted that the misalignment corrections that have been applied so far according to the first aspects of the invention are only effective if the substrate is in its correct position. This is not always the case. Absorption of ink by the substrate, friction and other factors can cause differences between the real advance of the substrate and the nominal advance, and therefore misalignment errors. According to one variant of the process according to the invention, a mark will be printed on the substrate by a print head for each band. This mark may be a single line along the Y direction. After the substrate has advanced, but before the next band has been printed, the first mark will be positioned to face a substrate feed sensor. The optical sensor is used to measure a distance between the first printed mark and the nominal position that this mark should have had if the substrate had advanced by its nominal amount. This real distance is used to define a real advance of the substrate $\Delta X_{real}$ that can be compared with the nominal value $\Delta X_{nom}$. A difference between the real advance and the nominal advance will automatically be corrected by a variation in the charge voltage applied to droplet charging means. This correction will be applied for all heads participating in writing the current band. As was seen above, the different corrections according to the invention that have just been defined can be applied independently of each other in an isolated manner. In particular, if one of the corrections is not necessary considering the observed quality of the printer, it will not be applied. They can also be applied in combination with each other according to different combination modes depending on the number of corrections.

The invention also relates to a continuous deviated jet printer projecting droplets in rows 1 to N in bursts, the droplets in a burst possibly but not necessarily being directed towards a printed substrate depending on data defining a pattern to be printed, the printer being equipped with at least:

- a print head, this head comprising means of separating at least one ink jet into droplets, and an associated droplet charge electrode, means of deviating a proportion of the droplets to the print substrate,
- means of servocontrolling the ink viscosity as a function of its temperature,
- means of servocontrolling the velocity of ink jets output from the print head,
- means of servocontrolling the distance at which the jet is broken into droplets,
- means of servocontrolling the phase difference between the times at which droplet charge pulses are applied and times at which droplet formation pulses are applied,
- means of controlling the printout consisting of means of injecting the charge of droplets to be aimed at the substrate as a function of their rows in the burst, coupled to the droplet charge electrode, characterized in that the print control means comprise:

- means of memorizing errors between a nominal position of dots printed by the print head and a real position of these dots,
- means of correcting the static translation 0,
- expansion correction means, the correction means receiving data originating from error storage means and being coupled to means of calculating droplet charge voltages.

BRIEF DESCRIPTION OF THE DRAWINGS

A printer comprising means for embodiment of the process according to the invention and other details of the process according to the invention will now be described with reference to the attached drawings in which:

FIG. 3 is intended to explain translation and expansion errors. This is done by showing nine different positions and shapes of a frame formed by a burst of droplets, in different configurations on the substrate plane materialized by XY axes. In the example shown, nine droplets have been used and are shown at exaggerated spacings, to simplify the explanation.

Figure 3:
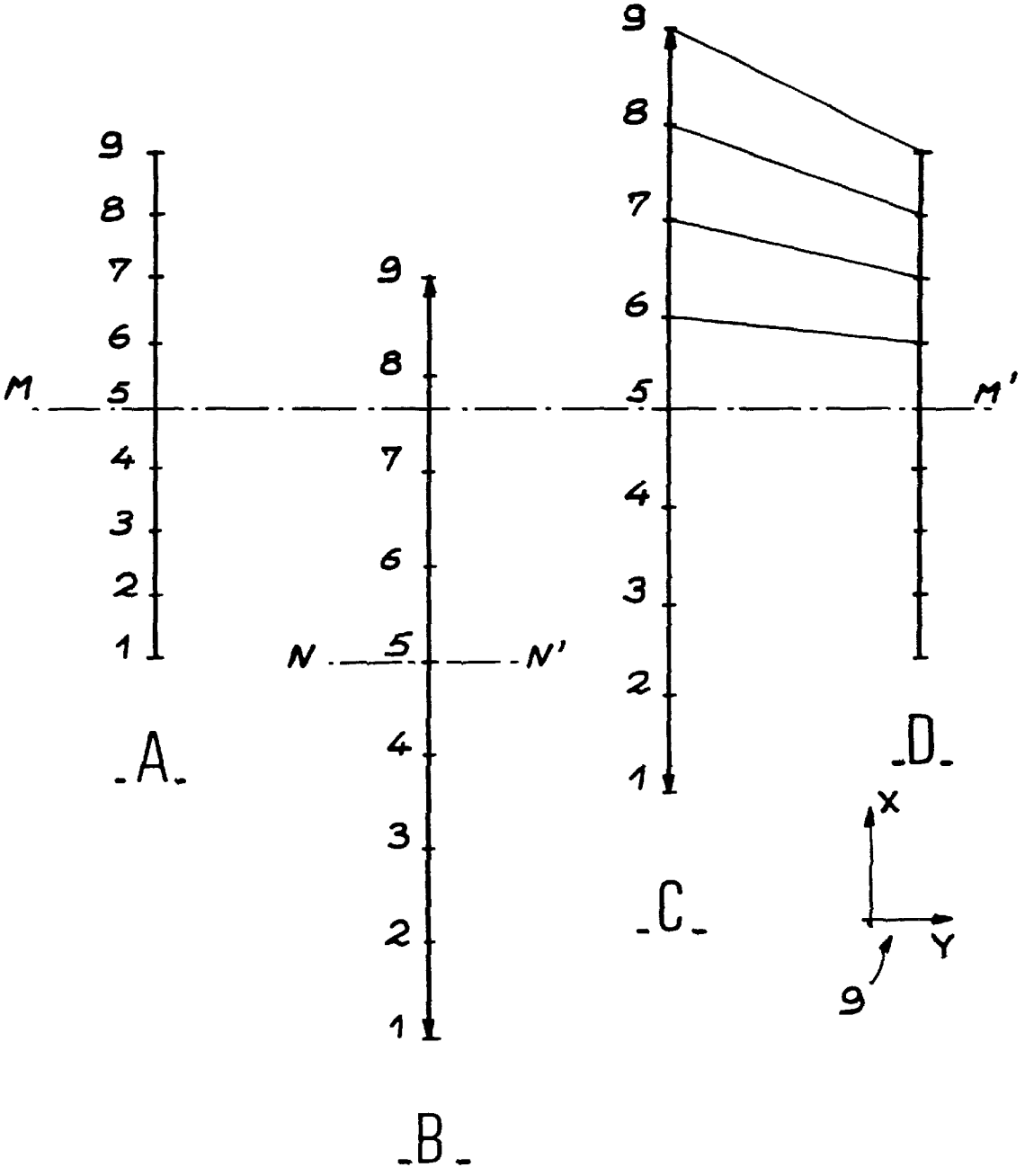
FIG. 3 is a diagram explaining the meaning of translation errors, expansion errors and corrections to them.

Part A of FIG. 3 shows the frame of nine droplets in accordance with its nominal position defined by an axis of symmetry line MM'. This axis of symmetry is perpendicular to the center line of the frame shown in A, therefore at the nominal position. Part B shows the frame as it was printed. On this frame, it can be seen firstly that it is offset as materialized by the position of its center line NN' being offset from the position of the line MM', and secondly that it is expanded, in other words the distance between droplet 1 and droplet 9 as shown in B is greater than the distance between droplet 1 and droplet 9 as shown in A.

In FIG. 3, the N droplets 1 to 9 in part B have been shown as being equidistant for simplification purposes. Obviously, this may not be the case in reality and distances between the different droplets could be variable. The result is that the position of the central droplet as materialized by the line NN' will not always be representative of the translation error.

In the more general case, the best estimate that can be made of the translation offset will be represented by the distance between the center of gravity of the droplets in the nominal positions as shown in A and the center of gravity of the droplets in the real positions as shown in B. The position of these centers of gravity will be calculated by applying the same coefficient to the droplets, for example a coefficient equal to 1.

For simplification purposes, it would be possible to compare the centers of gravity of an integer number a of droplets in the frames represented in A and in B, these droplets being in their corresponding nominal positions. For example, if droplets 4, 5 and 7 are taken at A, the same droplets 4, 5 and 7 will be used for the calculation of the center of gravity at B.

Experience has shown that in general, it is sufficient to use the positions of the first and last droplets, namely droplets 1 and 9 in the case shown in FIG. 3. The offset in the translation will then be equal to the offset between points at equal distances from droplets 1 and 9 as shown at A, and droplets 1 and 9 as shown at B. The effect of the static translation correction is to shift the centerline NN' of the frame as printed to the position MM'. In this position, the lines MM' and NN' are coincident.

This static translation correction will be achieved by modifying the charge applied to each of droplets 1 to 9. The calculation of the magnitude of this modification to the charge applied to droplets 1 to 9 will be made taking account of data input on machines of the same type. These data may include tables representing the displacement of the row j droplet as a function of the correction made to the nominal charge of this droplet.

After the static translation correction, the frame composed of 9 droplets is in the correct position with respect to the line MM', as shown in C, but its height in the case shown at C in FIG. 3 is greater than the nominal height as shown at A in FIG. 3. This frame could also be too small. The expansion correction will consist of calculating the change to be added to the nominal charge already corrected by the static translation error to bring these droplets into their nominal position.

In the case shown in FIG. 3, in which a uniform expansion of all droplets making up the frame has been shown, it is considered that the correction to the position of the extreme droplet 9 would require a greater charge correction for example, than the correction to droplet 6. In the case shown in FIG. 3, there is no need for expansion corrections to the position of the central droplet 5. In the more general case, it will be necessary to calculate the change to be made to the charge on each of the droplets to bring it from its position after it has been corrected by application by the static translation correction, to its nominal position.

As in the case of the static translation error correction, this expansion error correction will be calculated taking account of data acquired on previous printers.

Figure 4:
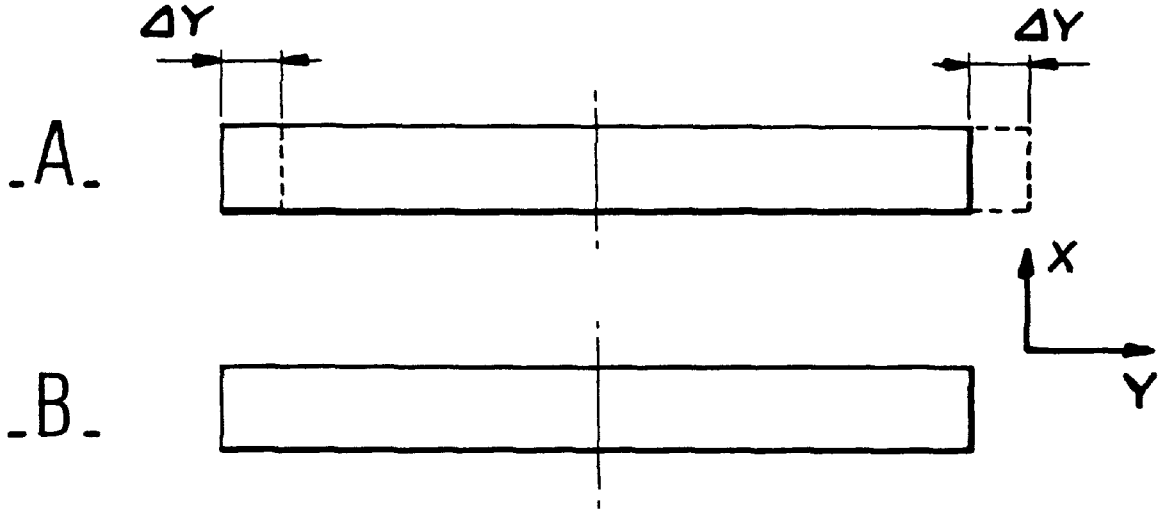
FIG. 4 is a diagram intended to explain dynamic offset errors in the scan direction and their corrections.

FIG. 4 is intended to explain the dynamic offset error and its correction. Part A in FIG. 4 shows the nominal position of a band in solid lines. This band is shown in the form of a rectangle with height equal to the height of a frame made by a burst comprising N droplets and its width is equal to the distance between the first and last frame in the band. For example, the print position of a frame in the scan direction is determined by marking the position of the print head relative to a position determination rule.

This rule has graduations, for example magnetic or optical graduations co-operating with components of the print head or of a support for the print head such that the printer control unit knows the position of the print head at all times. If the position of an edge of the print substrate and the position of the head with respect to this rule are known, the precise position of the head with respect to the substrate can be determined. The nominal position of the first frame is obtained by comparing the position of the head with respect to the substrate with the predetermined position of this first frame with respect to the edge of the substrate, as a function of data defining the pattern. For example, these data might determine that the first frame must be located at 2000 position marks on the rule starting from the edge of the substrate. Printout of the first frame will start when a position counter has been incremented by 2000. Assume that the difference $\Delta Y$ between the real position of the band in dotted lines and its nominal position is offset towards the right as shown in A, for example by twenty positions.

According to the invention, printing of each frame will be modified by the number $\alpha$ of positions necessary to bring the frames from their real positions to their nominal positions. In particular, the first frame that materializes the beginning of the band will be brought from its real position to its nominal position. In the numeric example chosen above, printing of the first frame will begin when the position counter has counted (2000−20)=1980 positions after detecting the left edge. All frames in the band will be offset by this number of positions. If printing also takes place during the return movement of the print head, the printout of the last frame must begin, for example, as a function of numeric data starting from position 100 000, the value 100 000 will be replaced by the value 99 980 to take account of the offset error of the real band equal to twenty positions. This correction will result in the band position as shown in FIG. 4, part B. It can be seen that the dynamic offset correction applied to each frame will make the real position of the band coincident with the nominal position of the band.

Another possible complement to this invention will now be explained with reference to FIG. 5.

This complement to the invention relates to a position variation of a band due to a variation in the substrate advance. This correction applies to printers in which the substrate is advanced step by step after each band has been printed. According to this aspect of the invention, a first mark shown as A in FIG. 5 will be printed while printing a current band. This mark may consist of a single line printed using one or several droplets in consecutive rows.

Figure 5:
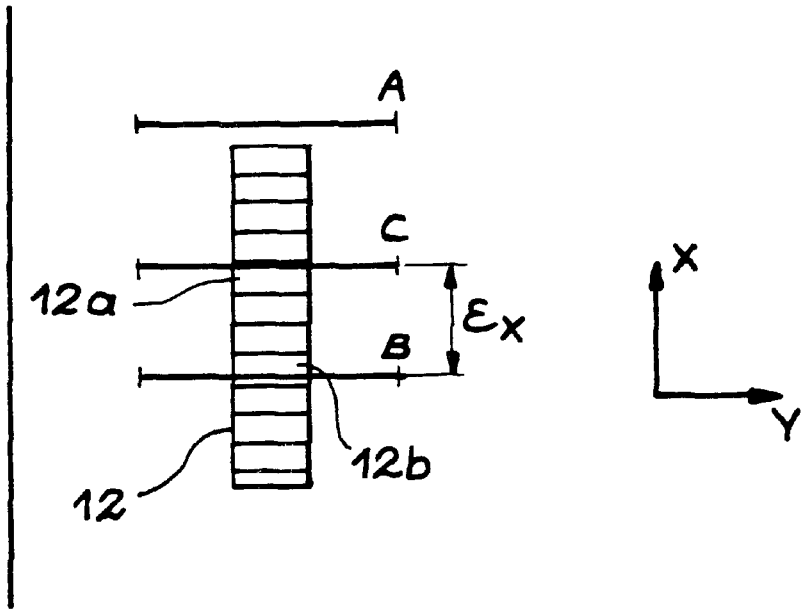
FIG. 5 is a diagram intended to explain the method of correcting substrate advance errors.

After the substrate advances and before the next band is printed, this mark is displaced to occupy the position shown at B in FIG. 5. In order to materialize the substrate advance error $\epsilon x$, a dummy mark has also been shown at C, representing the nominal position at which mark B should have been if there were no difference between the nominal position and the real position. Mark C is not physically present on the substrate. The difference between the dummy mark at C and the position mark at B is used to determine the error $\epsilon x$ between the nominal position mark at C and the real position at mark B. According to this aspect of the invention, this variation in the substrate advance will be compensated by a modification to the charge of droplets printed during this band.

The error $\epsilon x$ between the mark B and the nominal position C of the band that will be printed will be detected using a sensor 12, for example a CCD detector capable of measuring this difference, for example by counting the difference in the number of a sensor element 12*a* that receives the mark when it is in the nominal position, and a sensor element 12*b* that actually receives it. This sensor will preferably be placed facing the substrate and laid out such that its measurement field is capable of detecting the mark with fairly wide tolerances. Preferably, this sensor will be a sensor with a given light wavelength and will be used in cooperation with a transmitter, transmitting this determined wavelength towards the substrate.

Figure 6:
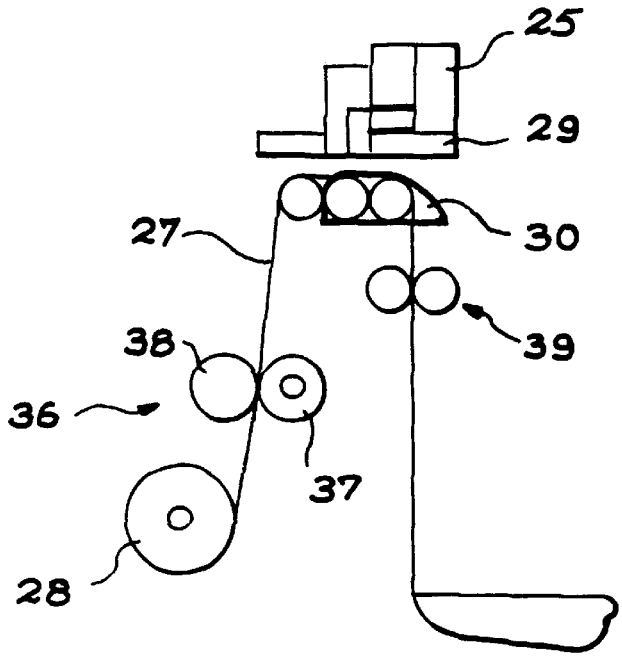
FIGS. 6 and 7 are diagrams illustrating the hardware components of a printer.
Figure 7:
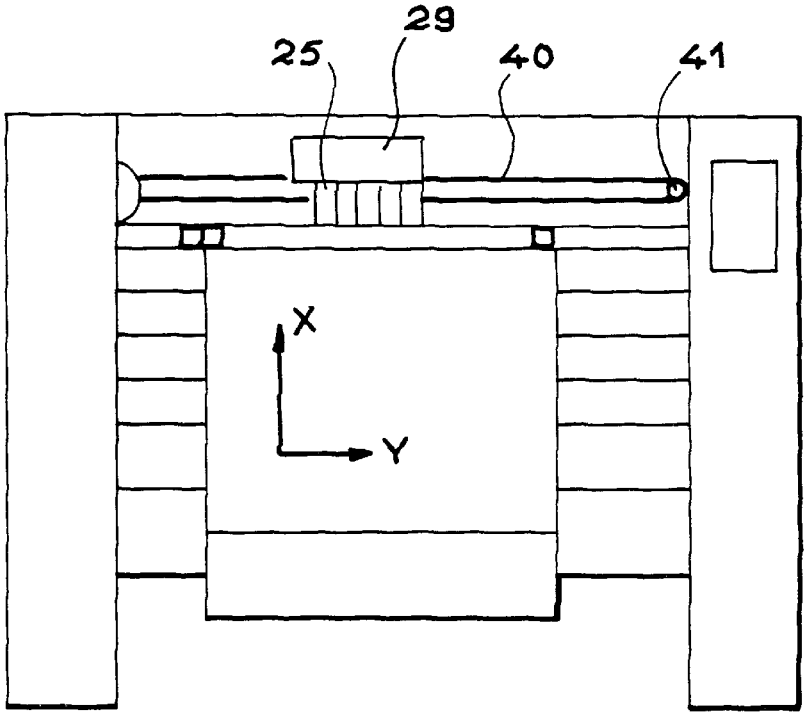

FIGS. 6 and 7 are principle diagrams for colored pattern printers using an ink jet, showing some features necessary for embodiment of the invention.

The system illustrated in FIGS. 6 and 7 shows an architecture for printing large formats solely for non-limitative examples. Printing is done by successive scanning in the Y direction. The system uses a substrate 27 starting from a coil 28 in a known manner, the advance of the substrate on the output side of the print unit 29 being controlled by a pair 36 of drive rolls 37, 38 in contact with each other.

A first roll 37 is motor-driven, and a second roll 38 applies counter pressure at the contact point. The two rolls 37, 38, trap the substrate and drive it with no slip. An encoder, not shown since it is known in itself, checks the advance of the substrate 27, using angular positions mounted on the spindle of one of the rolls. After each intermittent advance of the roll, the area on the substrate to be printed is held flat on a print table 30 located under the scanning path of the print unit 29. It is held flat by means of a second drive system 39 on the output side of the print unit.

This second drive system 39 keeps a constant tension on the substrate 27. An intermittent vacuum is sometimes applied to the print table to improve the flatness of the substrate 27 in the print area.

Figure 1:
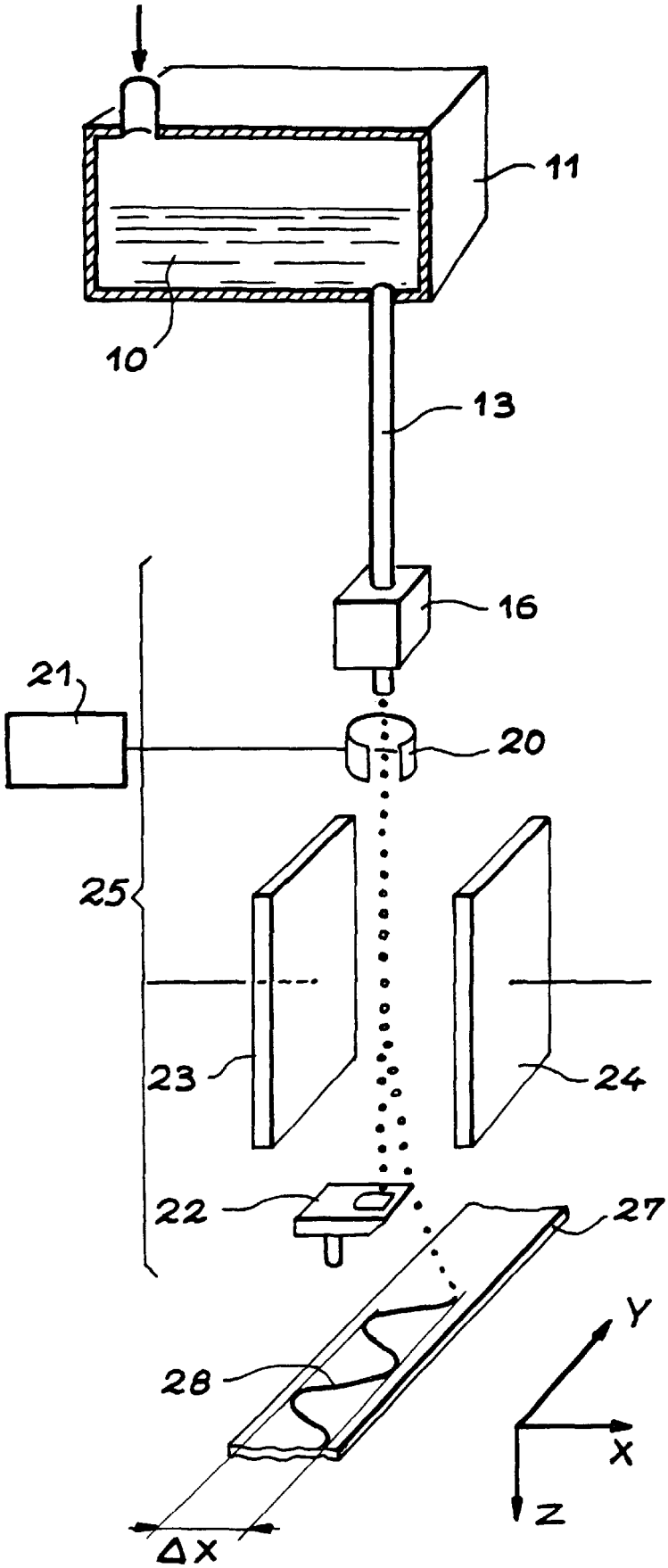
FIG. 1, already described, is a diagrammatic view of the means necessary to create ink droplets and to deviate them to a substrate.

The ink jet print unit 29 is composed of several print heads 25, for example as shown in FIG. 1, each head being supplied by one of the primary colored inks from reservoirs 11 using an umbilical cord or distribution duct 13.

The different print heads 25 print on the substrate simultaneously when it is not moving. The print unit prints a band by scanning in the Y direction. The scanning movement of the print unit with respect to the substrate is achieved by a belt 40 fixed to the print unit and driven by a motor-driven pulley 41. The print unit is guided in a known manner by a mechanical spindle not shown.

Each print head prints a band with constant width L. Print heads can be offset in the direction X along which the substrate advances such that a head does not necessarily print the same band at the same time as another print head corresponding to a different colored ink. After each scan, the substrate is advanced by a distance increment $\Delta X$ equal to not more than the band width L, but more generally equal to a sub-multiple of L for printing in several passes.

The spacing of print heads along the Y direction and possibly along the X direction firstly enables a sufficient drying time between deposition of different ink colors, and secondly enables an order for identical superposition of colors even when printing is done during the forward and return movements of the print head.

The jet of ink droplets and the scanning position of the print heads 25 with respect to the substrate 27 are synchronized by an optical detector not shown near the edge of the strip. The strip edge detector is fitted on the print head or on a print head support to detect each of the two edges. This detector emits a detection signal for each edge of the strip. This reference strip edge detection signal, for example for detecting the left edge, is then used to start a position counter that synchronizes the position of each print head with the print data for this position, contained in the print memory. The position encoder may be an optical or magnetic rule mounted on the mechanical scan guide rod.

Compared with a known print system as shown in FIGS. 6 and 7, the invention is distinguished in that it may be equipped with one or several detectors 12 (FIG. 8) detecting the real advance of the substrate. There is a left substrate advance detector if printing is done from left to right, and a second right substrate advance detector if printing is also done from right to left. Also, and in a known manner, a single substrate advance detector may be fitted on the print head or on a print head support to detect advance of the substrate when printing is done from left to right or from right to left.

Figure 2:
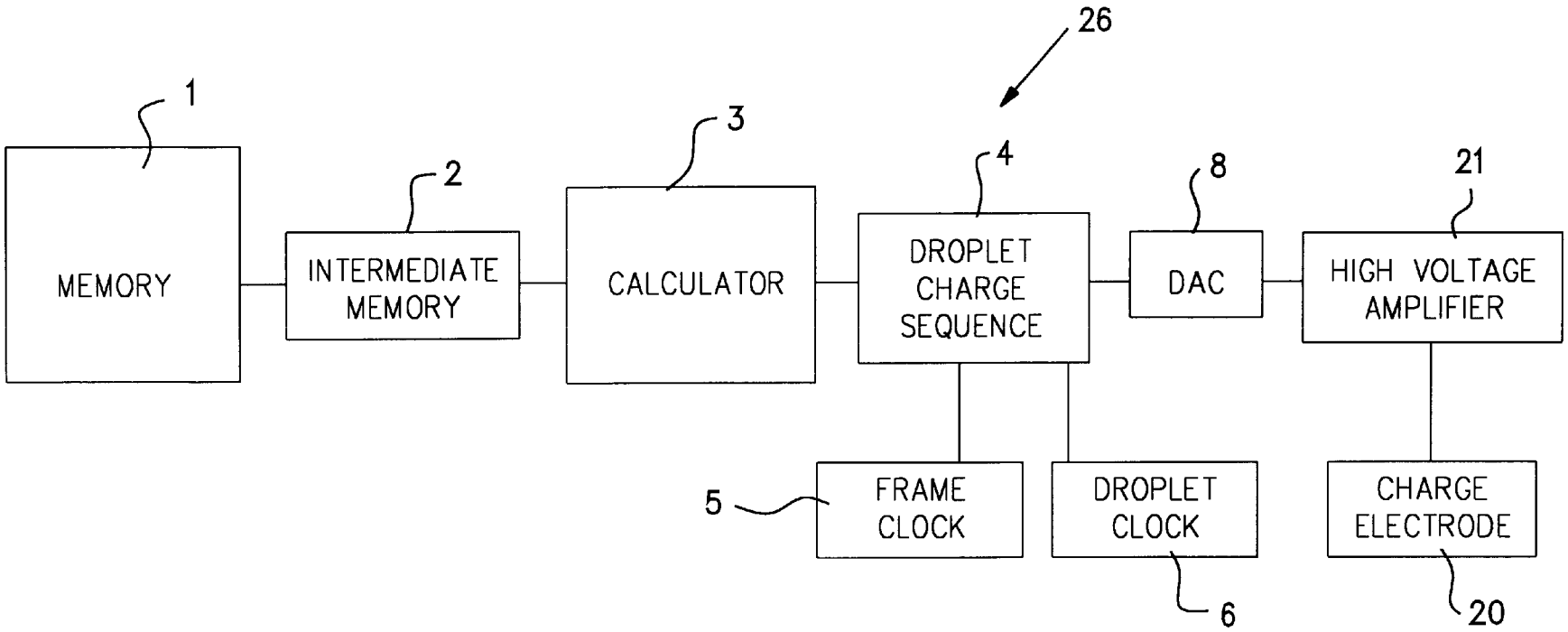
FIG. 2, already described like FIG. 1 within the framework of the description of prior art, shows all calculation means necessary for the operation of the means shown in FIG. 1.

Another important difference between a printer according to the invention and a known printer is related to the means of controlling the voltage of the droplet charge electrode. A device according to prior art has been described above with relation to FIG. 2.

Figure 8:
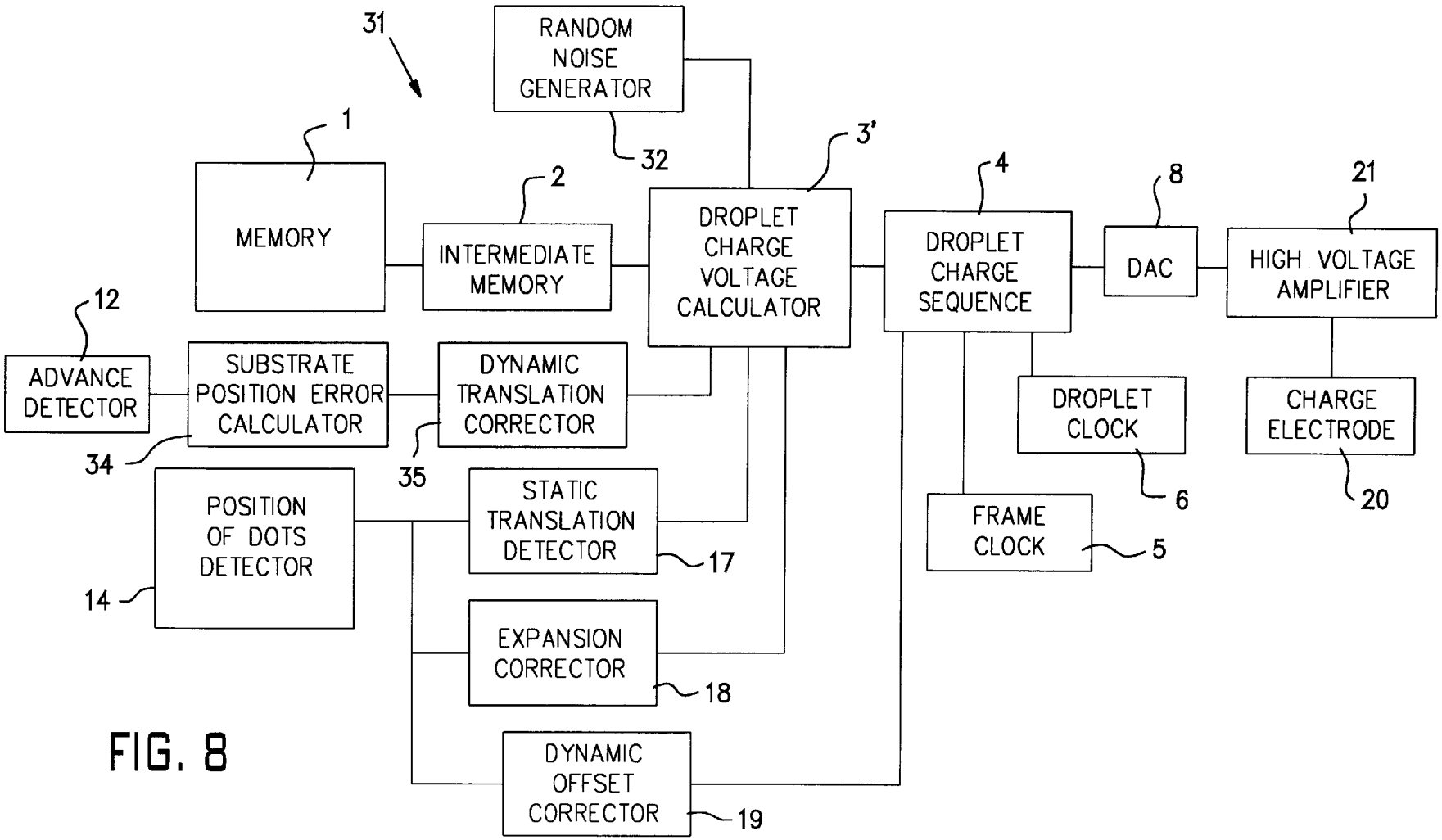
FIG. 8 is a diagram representing calculation means for a printer operating according to the process according to the invention.

FIG. 8 shows control means 31 according to the invention. In these control means 31, elements with the same function as the elements shown in FIG. 2 have the same reference number. Compared with control means 26 shown in FIG. 2, the device according to the invention may be fitted with one or several of the means described below.

The device according to the invention may comprise the detector 12 detecting the difference between the real advance of the substrate and its nominal advance, a substrate position error calculator 34 and a dynamic translation corrector 35 to correct droplet charges to compensate for the difference observed by the calculator 34. The detectors 12, the position error calculator 34 and the dynamic translation corrector 35 are connected in series with each other and the dynamic translation corrections $\phi$ calculated by the corrector 35 are applied to the droplet charge voltage calculator 3'.

Control means for the position and deviation of the jets may also comprise a detector 14 detecting the difference between the real position of dots printed by a jet compared with the nominal position of dots printed by the said jet. The differences between the positions of dots printed by the jet are input firstly into a static translation corrector 17, and into an expansion corrector 18, and finally into a dynamic offset corrector 19.

Finally, the ink droplet charge control means may comprise a random noise generator 32, the output of which is applied to the droplet charge voltage calculator 3' in order to modify the charge on each droplet in a random manner. Operation takes place as follows.

The detector 12 detects the difference between a mark on the current band that will be printed and the nominal position of this band. This difference is input into the error calculation calculator 34. This calculator calculates the value of the advance error $\epsilon_x$ of the substrate 27, as a function of the signal transmitted by the sensor 12. This difference is input into the dynamic translation corrector 35 that will calculate corrections to be applied to the droplet charge voltage calculator 3' to correct this dynamic translation $\phi$.

The calculator 14 that calculates the difference between the position of dots printed by each jet compares the position of printed dots on a pattern with the position of the corresponding dots on a reference pattern. This error calculation may be made automatically, for example by scanning the printed pattern and using the memorized reference pattern. The static translation corrector 17 will use the calculated differences to calculate the displacement of the center of gravity of a points for which the position error was measured, using one of the methods described above. Similarly, the expansion corrector 18 will calculate the difference between a printed dot and the corresponding nominal dot.

A correction value to the charge applied to each of the ink droplets will be calculated as a function of this error. The corrections $\theta_j$ calculated by the static translation correction calculator 17 and $\delta_{ij}$ calculated by the expansion corrector 18, are both applied to the droplet charge voltage calculator 3'. The droplet charge voltage calculator 3' will calculate the algebraic sum of the voltages to be applied to the droplet charge electrode as a function firstly of the nominal voltage determined from the frame description originating from memory 2, and secondly the static translation correction $\theta_j$ from the static translation corrector 17, the expansion correction $\delta_{ij}$ from the expansion correction corrector 18, the dynamic translation correction $\phi$ calculated by the calculator 35, and finally as a function of the value output by the random noise generator 32. The dynamic offset correction $\alpha$ calculated by the dynamic offset corrector 19 will be applied to the droplet charge sequencer 4. In this way, the droplet charge as calculated by the droplet charge voltage calculator 3' will be applied to coincide with a position number of the position counter smaller or larger than the nominal position number depending on the algebraic value $\alpha$ of the dynamic offset, the positions being counted starting from the edge of the substrate.

Figure 9:
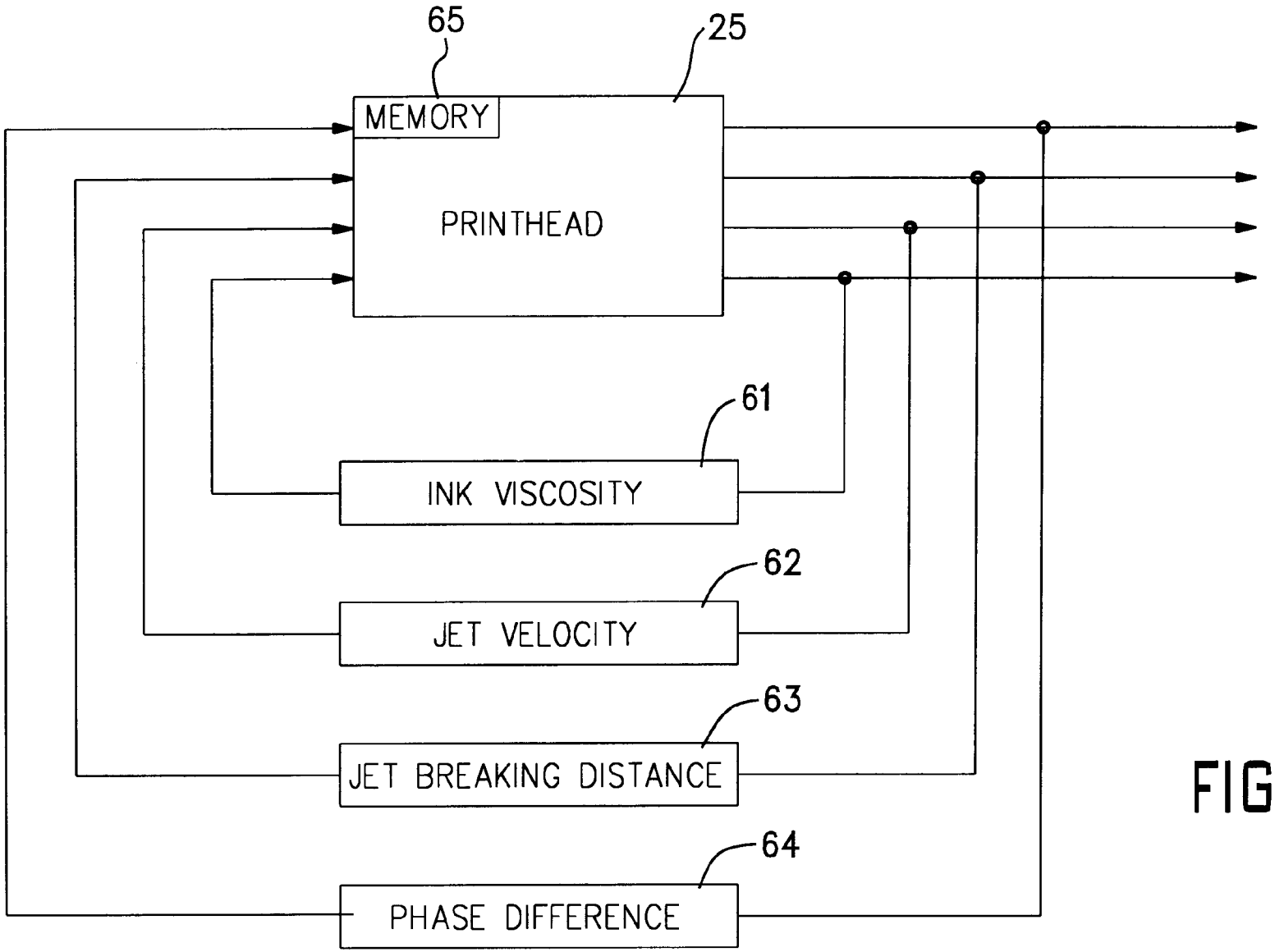
FIG. 9 very diagrammatically displays the servocontrols of a print head.

FIG. 9 very briefly shows a print head 25 and the various servocontrols associated with it. Each of the servocontrols on which brief comments are given below is known in itself. However, the inventors do not know of any printers that simultaneously use all these servocontrols on a single printer. The inventors believe that this omission is due to a poor understanding of the interference between the various parameters that have to be controlled to give a good print quality as described above. The printer according to the invention comprises a servocontrol of the viscosity 61 as a function of the temperature, shown like other servocontrols as a feedback loop from the output from head 25 to apply an error value to the input. The viscosity correction, if it is necessary, is made by adding solvent or by adding ink with a higher concentration of coloring agent in order to keep the proportion of coloring agent constant. The jet velocity 62 is servocontrolled by varying the ink feed pressure. The jet breaking distance is maintained by a servocontrol 63 that varies an adjustable parameter in order to maintain a predetermined breaking distance. For example, it could be the input voltage to a piezoelectric crystal causing vibrations in the ink. Finally, the printer according to the invention is equipped with a circuit 64 servocontrolling the phase between times at which electrical droplet charge pulses are applied and times at which droplet formation pulses are applied. This phase may be adjusted by varying a timer circuit.

Thus, in a printer according to the invention, when the viscosity is kept constant for a reference temperature, varying the pressure to modify the velocity will give genuinely predictable results such that this velocity can be kept constant at a predetermined value. Thus, the size of ink drops is genuinely constant. Since the concentration of coloring agent is also kept constant, the color of each droplet is genuinely constant. Finally, since the jet breaking distance and the phase are controlled, it is guaranteed that each droplet will receive an electrical charge that depends on an input voltage to the charge electrodes 20. In a printer in which all print parameters are controlled as described above, the positioning errors of ink drops compared with their nominal position is then only due to mechanical tolerances on the positions of print heads, and possibly on the diameter of the ink ejection nozzles. This is why the position can be corrected on this type of printer by varying the printer control electronics as described above.

In order to obtain a good reproducible print quality, the ink ejection velocity should be kept within limits around a set value. This set value may be obtained by varying the ink supply pressure depending on the print head, due to tolerances on ink outlet nozzles or the environment of the print machine. This is why a print head in a printer according to the invention will preferably comprise a memory in which the value of the set velocity for each jet will be stored, corresponding to a standard supply pressure to give the set velocity. This memory has been shown symbolically in FIG. 9 as 65. Therefore, the velocity servocontrol program will read this set velocity of the jet in the print head memory. Consequently, when the printer is in operation, and the pressure is adjusted within a range of values close to the standard pressure, it will be possible to detect significant jet velocity defects, in other words outside the mechanical tolerances of nozzles and specific to a single jet.

Similarly, the set values of the piezoelectric transducer control signal are predetermined during manufacturing and are stored in memory. Operating defects specific to a single transducer can be detected.

Also, it will not usually be necessary to change the program when one print head is replaced by another print head, since all nominal operating parameters are stored in memory.

What is claimed is:

1. Process for compensation of mechanical defects in an ink jet printer by adjusting the arrival position on a substrate (27) of electrically charged ink droplets in an adjustable manner using charge electrodes (20), the droplets originating from a print head (25) and the trajectories of the droplets being modifiable by deviation electrodes (23, 24) between N positions, between a first position $X_1$ and a last position $X_N$ and with N−2 intermediate positions, the N positions defining a frame in the form of a straight line segment approximately parallel to an X direction of the substrate (27), the process being characterized in that the following parameters are servocontrolled at all times during operation of the printer:

an ink viscosity value that remains within a predetermined tolerance as a function of its temperature, by adding solvent or ink with a higher concentration of coloring agents, a jet velocity by acting on the ink supply pressure, a distance at which the jet is broken into droplets by acting on an adjustable parameter to maintain a predetermined breaking distance, a phase difference between instants at which electrical droplet charge pulses are applied and instants at which droplet formation pulses are applied by action on a timer circuit, and in that the following steps take place during a phase prior to the print phases:

a) a pattern is printed, b) the said printed pattern is compared with a reference pattern to deduce an algebraic difference $\Delta X_i$ between a real observed position and a corresponding nominal position, for the said print head and for an integer number a of positions, where a is greater than or equal to 2 and less than or equal to N, for each of the chosen a positions, where i varies from 1 to a, c) a static translation error θ is determined as being the difference between the center of gravity of the a actual observed positions and the center of gravity of the corresponding a nominal positions, d) for each of the a observed droplet positions, a position error $\delta_1$ is observed between the real position of each droplet corrected by the translation error and the nominal position of each droplet, e) the value θ of the static translation error and the values $\delta_1$ of the droplet position errors from their initial nominal positions, are memorized, then, in each phase in which a pattern is printed defined by a set D of numeric data, a correction value to a nominal voltage is determined for each droplet to give a corrected value to be applied to the electrodes, this calculation taking account of the memorized values of static translation and position errors, the data extracted from the set D of numeric data defining the pattern to be printed, and row j, where j is between 1 and N, of the nominal target print position.

2. Process according to claim 1, in which the integer number a of observed real positions is equal to two, these positions being the first and last positions.

3. Process according to claim 1, in which the integer number a is equal to N.

4. Process according to claim 1, applicable to a printer provided with means of detecting the position of the print head (25) along the direction of movement of this head with respect to the substrate (27) and means of detecting the edge of the substrate characterized in that a dynamic offset ΔY between the nominal position of a printed band and its real position is measured during the phase prior to the print phases, this offset is memorized, and the print positions of the print head are offset during the print phases to compensate for the measured dynamic offset.

5. Process according to claim 1, characterized in that a random additional algebraic voltage is superposed on the nominal voltage to be applied to the means of charging each droplet to be directed towards the substrate (27), the maximum amplitude of this additional voltage being a fraction less than one of the difference between the nominal voltage to be applied to the charge electrodes for the said droplet, and the nominal voltage to be applied to the charge electrodes for one of the two immediately adjacent droplets in the frame.

6. Process for compensation of mechanical defects in an ink jet printer by adjusting the arrival position on a substrate (27) of electrically charged ink droplets in an adjustable manner using charge electrodes (20), the droplets originating from a print head (25) and the trajectories of the droplets being modifiable by deviation electrodes (23, 24) between N positions, between a first position $X_1$ and a last position $X_N$ and with N−2 intermediate positions, the N positions defining a frame in the form of a straight line segment approximately parallel to an X direction of the substrate (27), the process being characterized in that the following parameters are servocontrolled at all times during operation of the printer:

an ink viscosity value that remains within a predetermined tolerance as a function of its temperature, by adding solvent or ink with a higher concentration of coloring agents, a jet velocity by acting on the ink supply pressure, a distance at which the jet is broken into droplets by acting on an adjustable parameter to maintain a predetermined breaking distance, a phase difference between instants at which electrical droplet charge pulses are applied and instants at which droplet formation pulses are applied by action on a timer circuit, and in that the following steps take place during a phase prior to the print phases:

a) a pattern is printed, b) the said printed pattern is compared with a reference pattern to deduce an algebraic difference $\Delta X_i$ between a real observed position and a corresponding nominal position, for the said print head and for an integer number a of positions, where a is greater than or equal to 2 and less than or equal to N, for each of the chosen a positions, where i varies from 1 to a, c) a static translation error θ is determined as being the difference between the center of gravity of the a actual observed positions and the center of gravity of the corresponding a nominal positions, d) for each of the a observed droplet positions, a position error $\delta_1$ is observed between the real position of each droplet corrected by the translation error and the nominal position of each droplet, e) the value θ of the static translation error and the values $\delta_1$ of the droplet position errors from their initial nominal positions, are memorized, then, in each phase in which a pattern is printed defined by a set D of numeric data, a correction value to a nominal voltage is determined for each droplet to give a corrected value to be applied to the electrodes, this calculation taking account of the memorized values of static translation and position errors, the data extracted from the set D of numeric data defining the pattern to be printed, and row j, where j is between 1 and N, of the nominal target print position the process being applicable to a printer in which the substrate (27) is advanced step by step and printed by band, characterized in that:

a current band and a first mark are printed on the substrate (27), the substrate is advanced so that the next band can be printed, an algebraic difference between a nominal theoretical position of the mark and the real position is determined, for each droplet in a burst, a substrate advance correction is determined as being a dynamic translation correction voltage $\phi$ to be applied to the value of the charge voltage to be applied to each of the droplets output from the head to correct the deviation of the droplets and to compensate for the algebraic difference between the position of the substrate (27) and its nominal position, the calculated dynamic translation correction voltage $\phi$ to correct the substrate position is applied to each of the droplets in the burst directed towards the substrate (27).

7. Continuous deviated jet printer projecting droplets in rows 1 to N in bursts, the droplets in a burst possibly but not necessarily being directed toward a print substrate depending on data defining a pattern to be printed, the printer being equipped with at least:

a print head, this head comprising means of separating at least one ink jet into droplets, and an associated droplet charge electrode, means of deviating a proportion of the droplets to the print substrate, means of servocontrolling the ink viscosity, means of servocontrolling the velocity of ink jets output from the print head, means of servocontrolling the distance at which the jet is broken into droplets, means of servocontrolling the phase difference between the times at which droplet charge pulses are applied and times at which droplet formation pulses are applied, means of controlling the printout consisting of means of injecting the charge of droplets to be aimed at the substrate (27) as a function of their rows in the burst, coupled to the droplet charge electrode, characterized in that the printout control means comprises:

means of memorizing errors between a nominal position of dots printed by the print head and a real position of these dots, means of correcting a static translation $\theta$, which is the difference between the center of gravity of the real position of the dots and the center of gravity of the nominal position of the dots, dynamic expansion correction means, the dynamic expansion correction means receiving data originating from the memorizing errors means and being coupled to means of calculating droplet charge voltages.

8. Printer according to claim 7, characterized in that the printout control means also comprises means of correcting a dynamic offset, these means receiving data from difference storage means and being coupled to droplet charge calculation means.

9. Printer according to claim 7, characterized in that the print head comprises a memory.

* * * * *

UNITED STATES PATENT AND TRADEMARK OFFICE

CERTIFICATE OF CORRECTION

PATENT NO. : 6,464,322 B2
DATED : October 15, 2002
INVENTOR(S) : Alain Dunand

It is certified that error appears in the above-identified patent and that said Letters Patent is hereby corrected as shown below:

Column 10,
Line 59, please delete "0", and insert -- θ --.

Signed and Sealed this

Eighteenth Day of March, 2003

JAMES E. ROGAN
*Director of the United States Patent and Trademark Office*